US008607566B2

(12) United States Patent
Durrett et al.

(10) Patent No.: US 8,607,566 B2
(45) Date of Patent: Dec. 17, 2013

(54) INTERNAL COMBUSTION ENGINE WITH EMISSION TREATMENT INTERPOSED BETWEEN TWO EXPANSION PHASES

(75) Inventors: Russell P. Durrett, Bloomfield Hills, MI (US); Venkatesh Gopalakrishnan, Troy, MI (US); Paul M. Najt, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 334 days.

(21) Appl. No.: 13/087,638

(22) Filed: Apr. 15, 2011

(65) Prior Publication Data

US 2012/0260627 A1 Oct. 18, 2012

(51) Int. Cl.

| | |
|---|---|
| ***F02G 3/00*** | (2006.01) |
| ***F02B 25/00*** | (2006.01) |
| ***F02B 33/22*** | (2006.01) |
| ***F02B 41/06*** | (2006.01) |

(52) U.S. Cl.
USPC ..... 60/620; 123/70 R

(58) Field of Classification Search
USPC ..... 60/597–598, 297, 295, 304–305, 311, 60/620; 123/70 R, 68, 1 A
IPC ..... F01N 7/10,3/02, 3/20
See application file for complete search history.

(56) References Cited

U.S. PATENT DOCUMENTS

| | | | | | |
|---|---|---|---|---|---|
| 642,176 | A * | 1/1900 | Thomson | 123/1 R |
| 3,789,807 | A * | 2/1974 | Pinkerton | 60/597 |
| 3,872,839 | A * | 3/1975 | Russell et al. | 123/220 |
| 3,885,386 | A * | 5/1975 | Bachmann | 60/624 |
| 4,011,725 | A * | 3/1977 | Bachmann | 60/624 |
| 4,074,533 | A | 2/1978 | Stockton | |
| 4,715,326 | A * | 12/1987 | Thring | 123/70 R |
| 5,056,315 | A * | 10/1991 | Jenkins | 60/614 |
| 5,072,589 | A | 12/1991 | Schmitz | 123/70 R |
| 5,499,605 | A * | 3/1996 | Thring | 123/70 R |
| 5,930,995 | A * | 8/1999 | Watanabe et al. | 60/311 |
| 5,943,859 | A * | 8/1999 | Kawamura | 60/320 |
| 6,202,416 | B1 | 3/2001 | Gray, Jr. | |
| 6,301,888 | B1 * | 10/2001 | Gray, Jr. | 60/605.2 |
| 6,434,939 | B1 | 8/2002 | Beveridge | |
| 6,543,225 | B2 | 4/2003 | Scuderi | 60/597 |
| 6,651,432 | B1 * | 11/2003 | Gray, Jr. | 60/280 |
| 6,729,128 | B2 * | 5/2004 | Shiratani et al. | 60/297 |
| 6,742,331 | B2 * | 6/2004 | Minami | 60/297 |
| 6,817,182 | B2 * | 11/2004 | Clawson | 60/670 |
| 6,829,891 | B2 * | 12/2004 | Kato et al. | 60/297 |
| 6,865,882 | B2 * | 3/2005 | Minami | 60/295 |
| 6,945,036 | B2 * | 9/2005 | Kato et al. | 60/295 |
| 7,062,915 | B2 * | 6/2006 | Clawson | 60/670 |

(Continued)

FOREIGN PATENT DOCUMENTS

| | | | | |
|---|---|---|---|---|
| DE | 102005025731 | A1 * | 12/2006 | F01N 7/10 |
| EP | 1103298 | A1 * | 5/2001 | F01N 3/20 |

(Continued)

*Primary Examiner* — Thai Ba Trieu
(74) *Attorney, Agent, or Firm* — Reising Ethington, P.C.

(57) ABSTRACT

An internal combustion engine has a first work extraction station for extracting work from combustion and expansion of working gases. An emission treatment station treats the working gases after leaving the first extraction work station for reducing emissions. A second work extraction station receives the working gases from the emission treatment station for a second extraction of work from the working gases.

10 Claims, 2 Drawing Sheets

(56) References Cited

U.S. PATENT DOCUMENTS

| | | | | |
|---|---|---|---|---|
| 7,104,060 | B2 * | 9/2006 | Ogawa et al. | 60/597 |
| 7,201,156 | B1 * | 4/2007 | Wait | 123/70 R |
| 7,219,630 | B2 * | 5/2007 | Patton | 123/70 R |
| 7,353,786 | B2 | 4/2008 | Scuderi et al. | 123/68 |
| 7,681,394 | B2 * | 3/2010 | Haugen | 60/603 |
| 7,886,522 | B2 * | 2/2011 | Kammel | 60/280 |
| 7,950,231 | B2 * | 5/2011 | Vuk | 60/624 |
| 7,950,358 | B2 * | 5/2011 | Hu | 123/70 R |
| 8,191,354 | B2 * | 6/2012 | Cavataio et al. | 60/280 |
| 8,205,449 | B2 * | 6/2012 | Mondori et al. | 60/605.2 |
| 8,347,609 | B2 * | 1/2013 | Hepburn et al. | 60/280 |
| 8,371,256 | B2 * | 2/2013 | Durrett et al. | 123/70 R |
| 2003/0084666 | A1 * | 5/2003 | Ogawa et al. | 60/597 |
| 2003/0213231 | A1 * | 11/2003 | Tabata | 60/280 |
| 2006/0059910 | A1 * | 3/2006 | Spaeder et al. | 60/280 |
| 2007/0277514 | A1 * | 12/2007 | Kammel | 60/597 |
| 2008/0034739 | A1 * | 2/2008 | Ranalli | 60/295 |
| 2009/0107123 | A1 * | 4/2009 | Vuk | 60/295 |
| 2010/0154411 | A1 * | 6/2010 | Bruck et al. | 60/598 |
| 2010/0300385 | A1 * | 12/2010 | Durrett et al. | 123/64 |
| 2012/0023929 | A1 * | 2/2012 | Payri Gonzalez et al. | 60/598 |
| 2012/0216529 | A1 * | 8/2012 | Joshi et al. | 60/612 |

FOREIGN PATENT DOCUMENTS

| | | | | |
|---|---|---|---|---|
| EP | 1353046 | A1 * | 10/2003 | F01N 3/021 |
| JP | 07332072 | A * | 12/1995 | F01N 3/20 |
| JP | 2002364335 | A * | 12/2002 | F01N 7/10 |
| JP | 2010121521 | A * | 6/2010 | F01N 3/20 |
| WO | WO 2010052055 | A1 * | 5/2010 | F01N 3/20 |

* cited by examiner

INTERNAL COMBUSTION ENGINE WITH EMISSION TREATMENT INTERPOSED BETWEEN TWO EXPANSION PHASES

TECHNICAL FIELD

This disclosure pertains to an internal combustion engine system that provides treatment of combustion gases between first and second expansion phases of the gases.

BACKGROUND OF THE INVENTION

Internal combustion engines have a power stroke defined by combustion and expansion of working gases. In motor vehicles, it is required in many geographic regions to treat the discharged working gases for reducing emissions, particularly HC, CO and NOx and particulate emissions.

Present emission reducing technology requires that the discharged working gases need to be at a certain minimum temperature in order for the catalytic after-treatment process to be effective. If conventional engines were adjusted, i.e. by varying compression ratios, fuel ratios and valve timing to run most efficiently, the discharged exhaust gases would be cooler than the required minimum temperature. Therefore, current engine designs face a tradeoff between optimizing the work extraction from the working gases and leaving enough energy in the form of heat to allow catalytic converters to effectively clean the discharged working gases.

Thus, present internal combustion engine designs, for example Diesel, Otto, Rotary, or Atkinson cycle engines when used in an automotive vehicle compromise between maximum practical expansion during the power stroke and leaving enough heat in the output gases to provide for effective catalytic after-treatment. Typically, once the hot exhaust gases are treated, they are run through a muffler, or merely discharged to the atmosphere.

What is needed is an engine design that can capture more energy from the hot exhaust gases and convert it to work output, thus increasing the efficiency of an internal combustion engine but still provide for effective emission reduction.

SUMMARY OF THE INVENTION

In accordance with an embodiment of the invention, an internal combustion engine has an engine block with a first working chamber therein. A moving member is moveably mounted in the chamber for providing an intake phase, compression phase, a combustion and first expansion phase of the working gases and a discharge phase. A second expander provides a second expansion phase of the working gases after discharge from the working chamber. An emission treatment station is interposed between the first working chamber and the second expander for treating the working gases for emission reduction. The working gases are treated after being discharged from the first working chamber but before entering the second expander for the second expansion phase.

Preferably, the emission treatment station includes a catalytic converter for treating the working gases to reduce one or more of unburned HC, CO, NOx or particulate emissions. In one embodiment, the first working chamber is a cylinder and the moving member is a reciprocating piston and the second expander is a rotary device. In another embodiment, the second expander is a reciprocating device.

In accordance with another aspect of the invention, a method of emission management for an internal combustion engine includes providing an internal combustion engine with at least one working chamber and a moving member moved by a first expansion of the working gases in the working chamber for extracting work. The working gases are then treated after being discharged from the working chamber for reducing emissions. After treatment, the working gases pass to a second expander for additional work extraction from the working gases. The working gases are then discharged from the second expander. Preferably, the working chamber is a cylinder, the moving member is a reciprocating piston moveable in the cylinder; and the treating of the working gases is at a separate emission treatment station interposed between the working chamber and the second expander.

In one embodiment, the separate emission treatment station includes a catalytic converter. In one embodiment, the second expander is a rotary device.

In accordance with another aspect of the invention, an internal combustion engine includes a first work extraction station for extracting work from combustion and expansion of the working gases. An emission treatment station is connected to the first work extraction station for treating the working gases after leaving the first extraction work station for reducing emissions. A second work extraction station is connected to the emission treatment station for receiving the working gases from the emission treatment station for a second extraction of work from the working gases.

BRIEF DESCRIPTION OF THE DRAWINGS

Reference is now made to the drawing figures in which.

DESCRIPTION OF PREFERRED EMBODIMENTS

Figure 1:
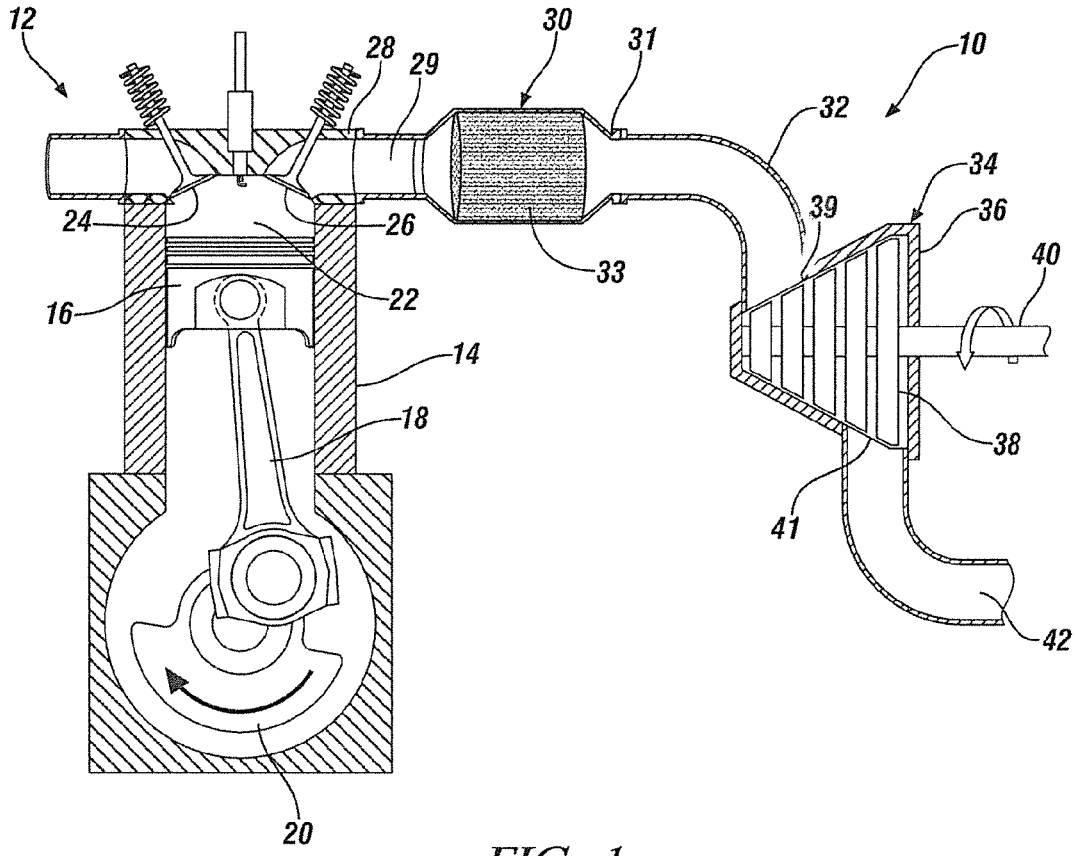
FIG. 1 is a schematic and segmented illustration of a multiple expansion phased engine with an emission treatment station interposed between the two expansion sections.

Referring now to FIG. 1, an engine 10 has a piston engine section 12. The engine section 12 can look conventional with an engine block 14, piston 16, crank arm 18, crankshaft 20 and working chamber 22 often referred to as a cylinder. Inlet and outlet valves 24 and 26 also commonly referred to as intake value 24 and exhaust value 26 allow for intake of air and exhaust or discharge of the working gases, also referred to as the combustion gases. The engine section 12 operates and functions like a conventional engine during the induction, compression and combustion phase. However, the power stroke or expansion phase is reduced compared to a conventional engine. As such, the working gases remain at higher pressures at the time when the outlet valves open and the discharge stroke commences.

While a piston engine is shown in FIG. 1 as the first expander, it should be understood other engines may be used. Diesel, Otto cycle, Atkinson, Miller cycle, Brayton cycle, or split-cycle engines, for example a Scuderi cycle, can also provide the first expander section. While not all of these engines have pistons, they all have working members which function analogously to a reciprocating piston in converting expanding gas to mechanical motion. Each of these engines can be modified to have an expansion phase with a reduced expansion ratio to reserve some of the expansion for later. At the end of the first expansion process, the pressure of the working gases is still relatively higher than atmospheric pressure. Furthermore, the temperature is higher than the minimum required for effective catalytic treatment.

The exhaust manifold 28 leads via conduit 29 to an emission treatment station 30, for example, a catalytic converter 33. The working gases are discharged from the working chamber 22 through opened exhaust valve 26 to the emission treatment station 30 at higher pressures and higher temperatures than a conventional cycle engine which enhances the effectiveness of the emission reduction process. The emission treatment station 30 may be a catalytic converter made from known ceramic materials with known porous channel structures. The emission treatment station 30 can reduce unburned HC, CO, NOx or other particulate emissions produced from the initial combustion process. The adjustable pressure range in the emission treatment station may be between 3 and 10 bar absolute.

Figure 2:
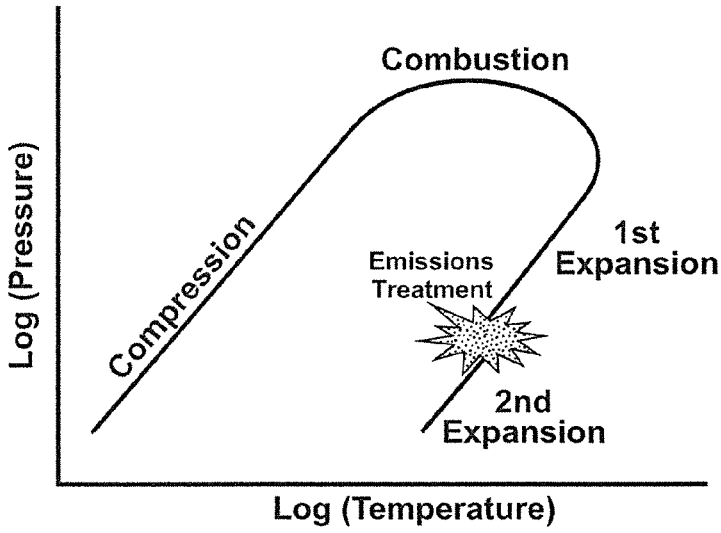
FIG. 2 is a schematic chart illustrating the thermal cycle of the multiple expansion phased engine shown in FIG. 1.

Unlike conventional catalytic after-treatment systems, the downstream end 31 is not open to the atmosphere via a muffler or an open exhaust pipe. Instead, the downstream end 31 is connected to a conduit 32 which leads to a second expander 34 where more work is extracted from the still pressurized working gases. Further work is then extracted as much as possible. Due to the gas already having been cleaned, the final temperature of the expanded gas after the second expansion can be below temperatures where after-treatment is effective. In other words, further work can be extracted from the gas after the first expansion cycle. FIG. 2 schematically shows a thermal cycle of the dual expansion phase engine and more particularly when the emission treatment occurs during the cycle. During emission treatment, the temperature of the gases may increase due to the known catalytic processes. The second expansion then takes place after the emission treatment to further decrease the pressure and temperature.

Figure 3:
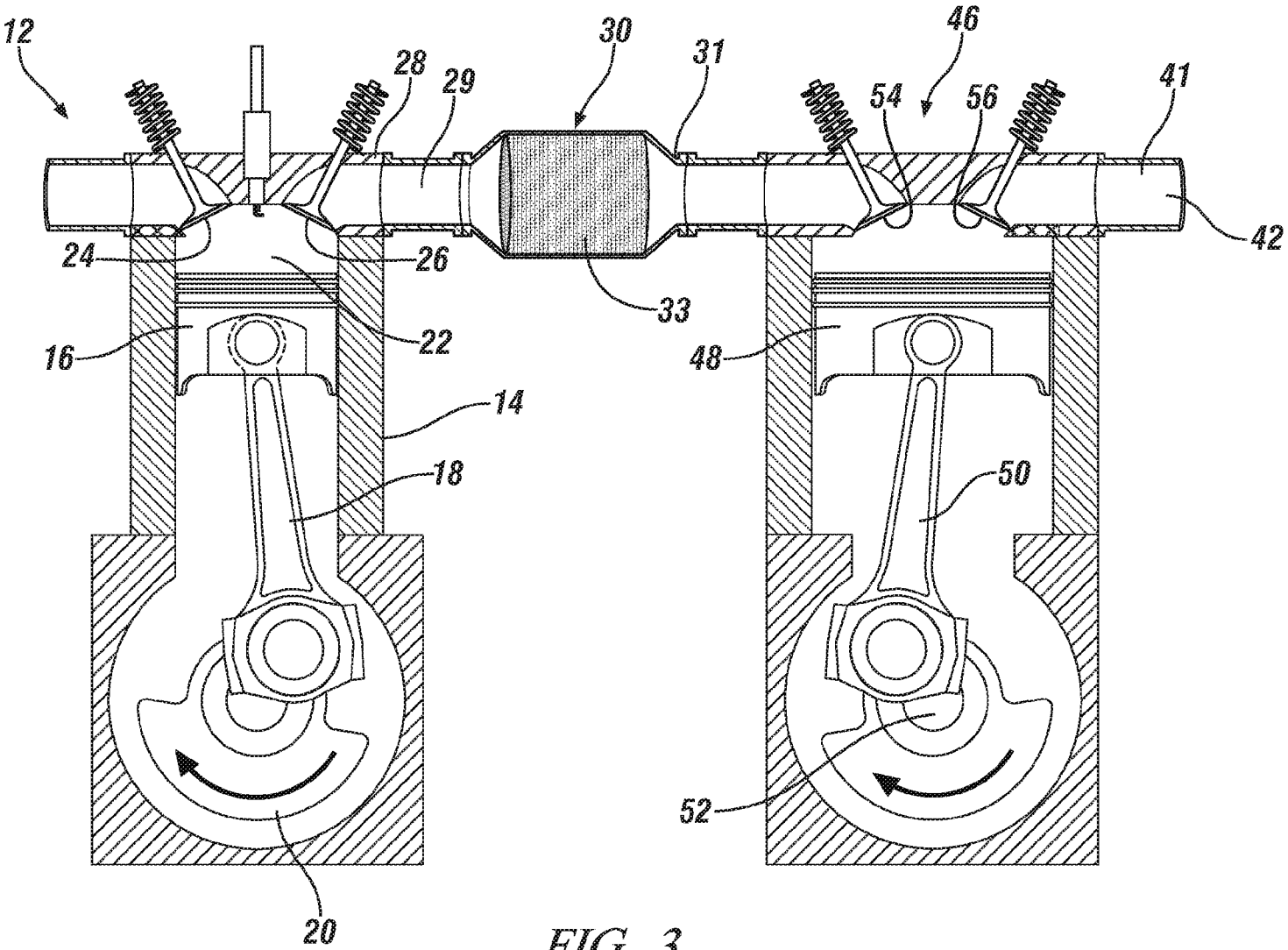
FIG. 3 is a schematic and segmented illustration similar to FIG. 1 showing an alternate embodiment where the second expander section is also a reciprocating device.

The second expander 34 may be a rotary turbine type with a housing 36, vanes 38 and output shaft 40 connected to the vanes directly or through reduction gears (not shown). An air motor construction, for example a vane air motor or the Di Pietro motor are also suitable for this second expander. The output shaft 40 then can be connected to the vehicle drive train or auxiliary generator system for example. It should be also understood that while a rotary expander 34 is illustrated, other expanders such as reciprocating expanders can also be used as the second expander as shown in FIG. 3, a reciprocating piston type expander 46 is illustrated where piston 48 is connected to crank arm 50 which in turn is connected to output shaft 52 that can be connected to the vehicle drive train or auxiliary system. Air control valves 54 and 56 commonly referred to as intake valve 54 and exhaust valve 56 are connected or timed with output shaft 52 for proper sequencing of opening and closing in similar fashion to the intake gate 39 and output gate 41 of the rotary turbine type second expander 34. The working gases enter into the emission treatment station 30 through open exhaust valve 26, and are treated in the emission treatment station 30 with the intake valve 54 closed. Exhaust valve 26 closes at the completion of the exhaust stroke of piston 16 to contain the working gases in the emission treatment station 30. Valve 54 is then opened to allow the treated working gases to enter the second expander 34 at the beginning of the second expansion phase, i.e. the downward stroke of piston 48. It should be noted that opening and closing timing of exhaust valve 26 is thus different than the opening and closing timing of the intake valve 54. It should be noted that to provide for a second expansion larger than said first expansion and not a mere transfer of gases, the second piston type expander 46 is larger than the piston 16 and working chamber 22 assembly as clearly shown in FIG. 3 i.e. the second working chamber 55 is larger than the working chamber 22 to provide a larger maximum volume than the maximum volume for the treated working gases of working chamber 22 for the untreated working gases.

After the second expansion, the working gases pass through the air control valve 56 or an output gate 41 and enter an exhaust system 42 open to the atmosphere which may include an exhaust muffler and tailpipe (not shown).

By having more expansion of the working gases providing work on the second expander 34 or 46, a more efficient engine with improved fuel consumption at very low emission levels is achieved in comparison to a conventional single expansion cycle engine.

This dual expansion cycle with an intermediate emission treatment station interposed between two expansion sections can be applied to a wide variety of internal combustion engines and allow for an effective emission treatment station working at higher pressures and higher temperatures than conventional catalytic converters.

By providing a second expander, the engine provides for a very high overall expansion ratio to extract the maximum amount of energy from the working gases and thus maximizes the efficiency of the engine.

The second expander can be a separate device thus allowing the first expander to be a conventional engine modified to have a shorter power and expansion stroke.

This dual expansion phase engine according to the invention does not compromise between emission control and fuel economy. The dual expansion phase engine instead improves both emission control and fuel economy simultaneously.

Variations and modifications are possible without departing from the scope and spirit of the present invention as defined by the appended claims.

We claim:

1. A method of emission management for an internal combustion engine comprising:

providing an internal combustion engine with at least one first working chamber and moving member moved in said chamber by a first expansion of working gases in the at least one of said first working chamber for extracting work;

providing an expander having an expander working chamber, wherein said expander working chamber has a maximum volume larger than a maximum volume of the at least one of said first working chamber such that said expander working chamber provides a second expansion larger than said first expansion;

providing an exhaust valve between the at least one of said first working chamber and an emission treatment station;

providing an intake valve between said emission treatment station and said expander working chamber;

opening said exhaust valve between the at least one of said first working chamber and an emission treatment station for discharging said working gases from the at least one of said first working chamber to said emission treatment station while said intake valve between said emission treatment station and said expander is closed;

closing said exhaust valve between the at least one of said first working chamber and an emission treatment station treating said working gases in said emission treatment station after being discharged from the at least one of said first working chamber for reducing emissions;

opening said intake valve between said emission treatment station and said expander working chamber for delivering said working gas to said expander working chamber to extract additional work from said working gas;

closing said intake valve between said emission treatment station and said expander working chamber; and discharging said working gases from said expander working chamber of said expander.

2. The method as defined in claim 1, wherein the at least one of said first working chamber is a cylinder;

wherein said moving member is a reciprocating piston moveable in said cylinder; and wherein said treating of said working gases is at a separate emission treatment station interposed between said first working chamber and said expander working chamber of said expander.

3. The method as defined in claim 2, wherein said separate emission treatment station includes a catalytic converter.

4. The method as defined in claim 1, wherein said expander is a rotary device.

5. The method as defined in claim 1, wherein said expander is a reciprocating device.

6. An internal combustion engine comprising:

an engine block with a first working chamber therein;

a moving member for motion in said chamber for providing an intake phase, compression phase, combustion and first expansion phase of working gases and a discharge phase;

wherein said first working chamber and moving member forms a first expander for said first expansion phase;

a second expander with a second working chamber that expands for providing a second expansion phase of the working gases within said second working chamber after discharge from the first working chamber;

an emission treatment station interposed between the first working chamber and the second working chamber in the second expander for treating the working gases for emission reduction after being discharged from the first working chamber and before entering the second chamber of the second expander for the second expansion phase;

an exhaust valve interposed between said first working chamber and said emission treatment station and constructed for selective opening during discharge of said working gases from said first chamber and entry of said working gases from said first working chamber to said emission treatment station and closing after discharge of the working gases from said first chamber; and an intake valve interposed between said emission treatment station and said second working chamber and constructed for selective closing during entry of said working gases from said first working chamber to said emission treatment station and opening of said valve after said emission treatment station treats said working gases to provide entry of said working gases to said second working chamber, said exhaust valve being closed when said intake valve is open;

wherein said second working chamber has a larger maximum volume than said first working chamber to provide a second expansion larger than said first expansion of said working gases after said working gases have been treated for emission reduction.

7. The internal combustion engine as defined in claim 6, wherein said emission treatment station includes a catalytic converter for treating the working gases to reduce one or more of unburned HC, CO, NOx and particulates.

8. The internal combustion engine as defined in claim 6, wherein said first working chamber is a cylinder, and wherein said moving member is a reciprocating piston.

9. The internal combustion engine as defined in claim 6, wherein said second expander is a rotary device having said second working chamber expanding as said rotary device rotates.

10. The internal combustion engine as defined in claim 8, wherein said second expander is a reciprocating device with said second working chamber expanding during a downstroke of said piston within said cylinder of said second working chamber.

* * * * *